United States Patent [19]

Münch

[11] 4,280,687

[45] Jul. 28, 1981

[54] FLAME CUTTER

[75] Inventor: Gerhard Münch, Frankfurt am Main, Fed. Rep. of Germany

[73] Assignee: Messer Griesheim GmbH, Frankfurt am Main, Fed. Rep. of Germany

[21] Appl. No.: 45,077

[22] Filed: Jun. 4, 1979

[30] Foreign Application Priority Data

Jun. 6, 1978 [DE] Fed. Rep. of Germany ..... 2824699

[51] Int. Cl.[3] ..... B23K 7/00

[52] U.S. Cl. ..... 266/50; 266/67; 266/73; 164/263; 148/9 R

[58] Field of Search ..... 148/9 R; 266/50, 72, 266/73, 66, 67; 83/245, 298, 318, 319, 320; 164/263

[56] References Cited

U.S. PATENT DOCUMENTS

| | | | |
|---|---|---|---|
| 3,641,856 | 2/1972 | Levy | 83/295 |
| 3,785,229 | 1/1974 | Halberschmidt et al. | 83/295 |
| 4,103,575 | 8/1978 | Tsuruta et al. | 83/320 |

FOREIGN PATENT DOCUMENTS

| | | |
|---|---|---|
| 2209288 | 5/1973 | Fed. Rep. of Germany . |
| 2226251 | 12/1973 | Fed. Rep. of Germany . |
| 2253650 | 5/1974 | Fed. Rep. of Germany . |
| 2262949 | 6/1974 | Fed. Rep. of Germany . |
| 2411972 | 1/1975 | Fed. Rep. of Germany . |
| 2416937 | 1/1975 | Fed. Rep. of Germany . |

*Primary Examiner*—L. Dewayne Rutledge
*Assistant Examiner*—John P. Sheehan
*Attorney, Agent, or Firm*—Ernest F. Marmorek

[57] ABSTRACT

A cutting machine for severing a moving strand portion includes an elongated support; the strand portion normally moves near the support in one direction of elongation thereof, and a carriage may be operably moved on the support in the one direction and in an opposite direction. A cutter is disposed on the carriage, and the movement of the carriage is synchronized with that of the strand by a rotatable roll in operative driven relationship from the strand. The rotation of the roll is selectively converted into a translatory motion of the carriage, so that the strand may be cut by the cutter, while it is moving in synchronism therewith.

8 Claims, 1 Drawing Figure

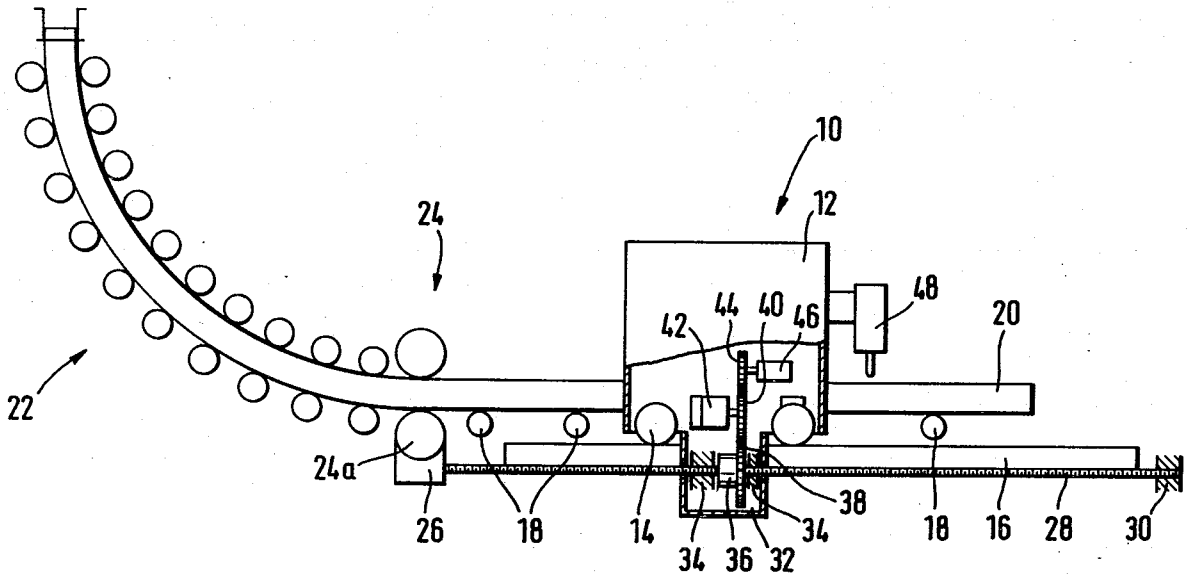
10
12
14
16
18
18
20
22
24
24a
26
28
30
32
34
34
36
38
40
42
44
46
48

FLAME CUTTER

BACKGROUND OF THE INVENTION

The present invention relates to a flame cutter for severing a continuously movable strand; it includes feed means for the strand, and discharge means for a severed portion of the strand. A carriage, which carries a welding torch, may be moved on rails along the longitudinal direction of the strand, includes a device for measuring the length of a portion of the strand to be cut off.

Flame cutting means of the aforesaid type have been known from the prior art, for example, from German laid-open patent application DE-OS No. 2,262,949, German Pat. DE-AS No. 2,416,937, or from German Pat. DE-AS No. 2,411,972.

Reference is also made to the pending application by Rupert Auer, assignor to the assignee of the present invention, entitled, "Welding Torch for Arc Welding, including a Consumable Electrode", Ser. No. 13,516, filed on Feb. 21, 1979.

In devices of the prior art, the flame cutter is displaced itself by means of its clamping arrangement in a longitudinal direction from the movable strand during the flame cutting process. Following completion of the cut, the clamping arrangement is released, and the machine returns by means of its own drive to its initial position, so that it may be clamped again to the strand, and so that a new flame cut may be started.

It has already been proposed in German Pat. DE-AS No. 2,226,251 to set the machine by means of so-called carriers onto the movable workpiece, in lieu of such a clamping arrangement, so as to move the machine during the flame cutting process.

This type of motion of the machine or carriage by means of a clamping arrangement leads, however, to problems, if a plurality of strands is to be cut by a machine of this type. Here it is necessary, so as not to endanger the parallel course of these strands, in view of the pressing forces exerted by the clamping arrangement, to arrange a distance piece between the strands, as can, for example, be ascertained from German Pat. DE-AS No. 2,209,288, or to keep the two strands apart by means of an additional clamping arrangement acting from above, as has been, for example, proposed by German Pat. DE-OS No. 2,253,650.

SUMMARY OF THE INVENTION

It is accordingly an object of the present invention to devise a flame cutting machine which obviates the disadvantages of the prior art, and which may move along with the continuously extruded strand, without, however, being directly connected to the strand.

This object is achieved, according to the present invention, by providing a cutting machine for severing a moving strand portion, which includes an elongated support, the strand portion normally moving near the support in one direction of elongation thereof, a carriage operably movable on the support in the one direction and an opposite direction, cutting means disposed on the carriage and actuatable for severing the moving strand portion, synchronizing means for synchronizing the movement of the carriage with that of the strand, the synchronizing means including a rotatable roll in operative driven relationship from the strand, and motion conversion means for selectively converting the rotation of the roll into a translatory motion of the carriage, whereby the strand may be cut by the cutting means while the strand is moving in synchronism therewith.

The motion means preferably include a normally stationary spindle nut secured to the carriage, and a spindle engaging the spindle nut, the spindle being in driven connection from the roll, whereby the carriage is movable in the same one direction and at the same speed as the strand.

The spindle nut is preferably rotatable, and it is advantageous to provide releasable brake means, inhibiting the rotation of the spindle, so as to activate the movement in the one direction of the nut by the spindle.

It is advantageous if the carriage has an initial position, and an end position, and if drive means are coupled to the spindle nut for returning the carriage by means of the nut and spindle from the end position to the initial position while the brake means is released.

It is further advantageous to provide measuring means operatively coupled to the spindle nut when the brake means is released, for determining a predetermined length of the strand portion, when the carriage is in the initial position; the measuring means preferably include means for activating the brake means following determination of the predetermined length of the strand.

It is advantageous if gear means are provided for coupling the drive means to the spindle nut, as well as supply roll means for guiding the moving strand to the carriage, and discharge roll means for discharging the second strand portion from the machine.

The invention also encompasses a method of severing a moving strand portion, with the aid of an elongated support, a carriage movable on the elongated support, a cutter disposed on the carriage and actuatable for severing the moving strand portion, and a rotatable roll in driven relationship from the strand.

The operating steps then include converting the rotation of the roll into a translatory motion of the carriage from an initial position to an end position, so as to synchronize the translatory motion of the carriage with the motion of the moving strand, concurrently severing the moving strand portion from a remaining portion of the strand, thereafter returning the carriage to the initial position, and thereafter repeating steps (a), (b) and (c) until a desired number of moving strand portions have been severed from a remaining portion of the strand, whereby the strand may be cut by the cutter while the strand is moving in synchronism therewith.

BRIEF DESCRIPTION OF THE DRAWING

For a fuller understanding of the nature and objects of the present invention, reference should be had to the following detailed description, taken in conjunction with the sole FIGURE of the drawing, which shows the flame cutter of the present invention in an elevational view.

DESCRIPTION OF THE PREFERRED EMBODIMENTS

In carrying the invention into effect, there is shown in the drawing a flame cutting machine 10, whose carriage 12 is operably movable on a support or rails 16, along a predetermined direction by means of wheels 14. Above the rails 16, there are disposed strand support means, such as supporting rollers 18, a strand 20, movable along the longitudinal direction of the rails 16, the strand 20 being disposed above the supporting rollers 18.

Drive means in the form of a motor 42 are arranged to drive the carriage 12 along the rails 16. A welding torch 48 is disposed on the carriage 12 for cutting the continuously cast strand, and guide means for the strand 20, in the form of rollers 24 and 24*a* are provided, the roller 24*a* at least being normally driven by the advancing strand. The guide means 24 and 24*a* are disposed near the platform or rails 16 for guiding the strand 20 towards, and past the welding torch 48. Motion conversion means in the form of a gearing 26, a threaded rod 28 and a spindle nut 36 ensure that the roller 24*a* is couplable to the carriage 12.

The strand 20, which extends below the carriage 12, passes from a (non-illustrated) strand casting machine, to which there is postcoupled a strand supply means 22 for the strand 20, which strand supply means 22 is shown in the drawing in a simplified manner. The strand strand supply means 22 consists of a plurality of rolls, by means of which the strand 20, passing in a vertical position from the strand supply means, is bent towards a horizontal position.

On the lower end of the strand supply means 22, there are shown the aforesaid roll pairs 24 and 24*a*.

The lower roll 24*a*, which is set in motion by the passing strand 20, is coupled to a gearing 26. The lower roll 24*a* engages the threaded rod 28 through the gearing 26, the axis of rotation of the threaded rod 26 being parallel to the rails 16.

The threaded rod 28 is supported on an end thereof, opposite the gearing 26, in a bearing 30. As can be seen, the threaded rod 26 is so dimensioned, that it extends over the entire length of the flame cutter.

Within the region of the threaded rod 28, there is provided on the carriage 12, a receiving arrangement 32, which carries the spindle nut 36 between two bearings 34. The spindle nut 36, as can be seen from the drawing, is disposed on the threaded rod 28, and is in turn connected via a toothed wheel 38, secured to the threaded rod 28, to a toothed wheel 40 of a motor 42.

The gearing 26, the receiving arrangement 32, and the threaded row 28 thus constitute single-stage synchronizing means for synchronizing the movement of the carriage 12 with that of the Strand 20.

The motor 42 includes brake means for halting the motion thereof, and in particular for braking the rotation of the spindle nut 36. The toothed wheel 40 is disposed on the drive shaft of the motor 42, which engages a further toothed wheel 44, which is in operative engagement with the axis of rotation of a displacement pickup 46. This displacement pickup 46 is a portion of a (non-illustrated) length measuring device, of the flame cutting machine.

At the beginning of a cutting process, the flame cutter 10, and the carriage 12, takes up an initial position at the commencement of the cutting path, which cutting path is defined by the length of the rails 16. This initial position of the flame cutter is shown in the drawings at left in the immediate vicinity of the first abutting roll pair 18. If the start of the cast strand 20 now comes within the region of the roll pair 24, then the lower roll 24*a* of the slowly moving strand 20 starts to rotate. As the roller 24*a* is engaged with the threaded rod 28 via the gear train 26, the threaded rod 28 will also be made to rotate.

As the rotatable spindle nut 36, which is disposed on a fixed location on the mounting 32 of the carriage 12, between bearings 34, cannot move in the longitudinal direction of the spindle 28, the spindle nut 36 is thereby made to rotate according to the rotation of the spindle 28. Both the motor 42, equipped with a brake, as well as the motion or displacement pickup 46, of the length measurement device, are then made to rotate also via the gear trains 38,40, and 44.

As the initial position of the flame cutter machine 48 is known with respect to the roller pair 24, the first partial length of the strand to be cut is determined by means of the motion or displacement pickup 46 of the length measuring device, starting with the roller pair 24.

If now a certain predetermined partial length of the beginning of the strand is determined by means of the motion or displacement pickup 46, then the braking mechanism of the motor 42 is switched on by the motion pickup through the length measuring device, so that therefore the gear drive 38,40, and 44 is blocked. This blockage in turn restrains the spindle nut 36 from rotating freely further on the spindle 28. As the spindle 28 continues to rotate in accordance with the longitudinal motion of the strand, the carriage 12 is now moved also by means of the blocked spindle spindle nut 36 in the longitudinal direction of the strand 20, with the same velocity as the strand 20 itself.

Concurrently with the blocking of the gear drive 38, 40, and 44, by the braking motor 42, the cutting process is initiated by other control impulses.

During the cutting process performed by the flame cutter 48, the flame cutting machine moves with the same velocity as the strand 20, without being clamped to the strand 20. Any change in the velocity of the strand 20 is immediately transferred by the roller pair 24, particularly the roller 24*a*, through the gear train 26, and to the spindle 28, without any delay to the flame cutting machine 10, which insures that the strand 20 and the flame cutting machine always move parallel to one another.

At the end of the cutting path, namely after the cutting has been completed, the motor 42 is switched on, and the carriage 12 is returned from its end position (shown in the drawing to the right) to its initial position, or to a new cutting location in fast motion, by means of the spindle nut 36, which in turn is driven by the motor 42, via the gear train 38 and 40.

By means of the constantly adding and subtracting motion of the displacement pickup 36, corresponding to the forward or reverse motion of the carriage 12, the new cutting location is automatically determined, at which location the braking motor 42 then is blocked again, so that the carriage 12 is then moved again, for the next cut by the spindle 28 in the longitudinal direction, and at the same motion of velocity.

By the inventive, contactless "coupling" of the flame cutting machine to the moving strand, it is advantageously arranged that any possible change of velocity of the strand 20 is immediately passed, and without any further delay, onto the flame cutting machine.

By the process of the flame cutting machine, which moves with the velocity of the strand by means of the inventive arrangement, it is advantageously possible not only to cut a single strand, but also twin strands, or a plurality of strands with a single cutting machine in a single process, without the machine having to be clamped to the strands, as has been the case hitherto.

I wish it to be understood that I do not desire to be limited to the exact details of construction shown and described, for obvious modifications will occur to a person skilled in the art.

Having thus described the invention, what I claim as new and desire to be secured by Letters Patent is as follows:

1. A flame cutting machine for severing portions of a moving strand, comprising in combination:

an elongated support, said strand operatively moving above and parallel to said support in one direction of elongation thereof, rail means disposed on said elongated support, a carriage having an initial position and being operably movable on said rail means in said one direction and in an opposite direction, cutting means disposed on said carriage and actuatable for severing said moving strand portions, synchronizing means for operatively and continuously synchronizing the movement of said carriage with that of said strand in said one direction, said synchronizing means including a rotatable roll couplable to said carriage and in operative driven relationship from said strand, motion conversion means for converting the rotation of said roll into a translatory motion of said carriage, in said one direction, and including a rotatable and arrestable nut disposed on said carriage, and a spindle in driven connection from said roll engaging said nut, releasable brake means for arresting rotation of said nut whereby the movement in said one direction of said nut and said carriage by said spindle is initiated, and, measuring means operatively coupled to said nut through said brake means for determining the moving distance of the carriage from the time of the activation of said brake means to the release thereof, whereby said carriage is movable in the same direction and at the same speed as said strand, said strand may be cut by said cutting means while the strand is movable in synchronization therewith in said one direction, and said carriage may be returned to said initial position following cutting of the strand by said cutting means.

2. A flame cutting machine as claimed in claim 1, wherein said carriage has an end position, and further including drive means coupled to said spindle nut for returning said carriage by means of said nut and spindle from said end position to said initial position while said brake means is released.

3. A flame cutting machine as claimed in claim 1 and further comprising measuring means operatively coupled to said spindle nut when said brake means is released, for determining a predetermined length of said strand portion, when said carriage is in said initial position, said measuring means including means for activating said brake means following determination of said predetermined length of said strand.

4. A flame cutting machine as claimed in claim 2, further comprising gear means for coupling said drive means to said spindle nut, supply roll means for guiding said moving strand to said carriage, and discharge roll means for discharging the severed strand portion from the machine.

5. A flame cutting equipment for severing parts from a moving strand, comprising in combination:

strand supply means, including a plurality of rolls, strand support means mounted downstream of said strand supply means;

a carriage operable on rails from said strand supply means over the length of said strand support means, said carriage being equipped with at least one flame cutting torch, movable perpendicular to the direction of the movement of the strand;

a length measuring device operable for determining the length of the part of the strand to be cut;

a spindle which extends over the entire length of the carriage movement parallel to the rails, said spindle being in driven connection from one roll of said strand supply means through a gearing, a nut engaged with said spindle and arranged in the carriage and arrestably rotatable, and brake means for inhibiting the rotation of said spindle nut, so as to activate the movement of said carriage;

said measuring means being operatively coupled to said nut by means of said brake means and determining the length of movement of the carriage by activating and inactivating the brake means.

6. A flame cutting machine for severing portions of a moving strand, and being free of any rigid mechanical connection with the strand, comprising in combination:

an elongated support, said strand portion operatively moving above and parallel to said support in one direction of elongation thereof, rail means disposed on said elongated support, a carriage having an initial position and operably movable on said rail means from said initial position in said one direction and thereafter in an opposite direction, to said initial position, cutting means disposed on said carriage and actuatable for severing said moving strand portion, synchronizing means for operatively synchronizing the movement of said carriage with that of said strand in said one direction, said synchronizing means including a roll couplable to said carriage and in operative driven relationship from said strand, and motion conversion means for selectively converting the rotation of the roll into a translatory motion of said carriage, whereby said strand may be cut by said cutting means while the strand is moving in synchronism therewith.

7. In a method of flame cutting portions of a moving strand, with the aid of an elongated support, rails disposed on said elongated support, a carriage movable on said rails, a cutter disposed on the carriage and actuatable for severing said portions from the moving strand, and a roll couplable to said carriage and in driven relationship from the strand, the steps comprising:

(a) converting the rotation of the roll into a forward translatory motion of said carriage from an initial position to a measurable end position, so as to operatively and continuously synchronize the translatory motion of the carriage with the motion of the moving strand, during said translatory motion, (b) measuring the distance covered by said carriage from said initial position to said end position, (c) concurrently with step (a) so as to correspond to a predetermined length of strand portion to be cut, severing a moving strand portion from a remaining portion of the strand, and (d) thereafter returning the carriage to said initial position, whereby said strand may be cut by said cutter while the strand is moving in synchronism therewith.

8. A method as claimed in claim 7, further comprising the step of repeating steps (a), (b), (c) and (d) until the entire moving strand has been cut into said portions, and wherein said elongated support, said carriage and said cutter are free of any rigid mechanical connection with the strand.

* * * * *